United States Patent [19]

Kee et al.

[11] Patent Number: 4,681,171

[45] Date of Patent: Jul. 21, 1987

[54] ONE-PERSON BATTERING RAM

[76] Inventors: Gene A. Kee, 49 Harmon St.; Mark Hanna, 50 Sterling St., both of, West Lynn, Mass. 01905

[21] Appl. No.: 754,476

[22] Filed: Jul. 12, 1985

[51] Int. Cl.[4] ..... B25D 9/00; A63B 59/00

[52] U.S. Cl. ..... 173/90; 273/81 R

[58] Field of Search ..... 173/90, 126; 404/133; 125/40; 405/271; 273/67 R, 84 R

[56] References Cited

U.S. PATENT DOCUMENTS

| | | | |
|---|---|---|---|
| 897,573 | 9/1908 | Beard | 173/126 |
| 2,449,454 | 9/1948 | Cooke | 173/126 |
| 4,350,214 | 9/1982 | Landaeus | 173/126 |

FOREIGN PATENT DOCUMENTS

| | | | |
|---|---|---|---|
| 106722 | 3/1939 | Australia | 173/126 |
| 104528 | 3/1917 | United Kingdom | 173/126 |

*Primary Examiner*—E. R. Kazenske
*Assistant Examiner*—Willmon Fridie, Jr.
*Attorney, Agent, or Firm*—Bromberg, Sunstein & Casselman

[57] ABSTRACT

A battering ram operable by one person for battering objects has in one arrangement a concrete-filled tube with first and second ends with an epoxy resin contact face at the first end, a first handle located proximate to the center of gravity of the body, and a second handle located at the second end.

5 Claims, 4 Drawing Figures

ONE-PERSON BATTERING RAM

DESCRIPTION

1. Technical Field

The present invention relates to battering rams in general and in particular to a battering ram operable by one person.

2. Background of the Invention

Battering rams have been used for centuries; designs operable by two or more persons are in widespread use in various fields, such as police work or firefighting, where the difference of a few seconds in gaining entry to a building through various barriers, such as locked doors, could mean the difference between life and death.

The two-person battering ram has proved to be an effective means of penetrating various structures. This ram is typically be used as follows: several feet away from the barrier to be penetrated, two strong men each grab hold of the ram by means of handles protruding from the body. They then charge at the barrier as quickly as they are able, under the circumstances, and the kinetic energy generated by the mass of the ram and the velocity at which it is carried forward hopefully proves to be sufficient to generate a sizeable enough force at impact to break through the barrier.

Thus, the two-person battering ram owes its efficacy to the mass of the ram and the velocity that can be generated by two men lifting the ram and running forward while carrying it.

However, the very elements that enable the ram to break through barriers are the same elements that produce the major drawbacks in the two-person ram. First, the two-person ram requires two strong men to operate. This results in an inefficient use of manpower to the extent that coordinating the efforts of two men is less efficient than one man operating alone. The second drawback is that although the two-person ram is quite effective in open situations with plenty of room for two men to run while maneuvering an extremely heavy and unwieldly object, it is virtually useless in close quarters, such as those typically found in the interiors of most buildings.

3. Disclosure of Invention

The present invention overcomes drawbacks of the prior art rams by being light enough so that it can be operated by one person. In addition, as no running is required to generate the requisite amount of kinetic energy, it can consequently be used to effect speedy barrier penetration in close quarters.

A preferred embodiment of the invention provides a battering ram operable by one person for battering objects. In this embodiment, the ram includes a concrete-filled tube with first and second ends with an epoxy resin contact face at the first ends, a first handle located proximate to the center of gravity of the body, and a second handle located at the second end.

DESCRIPTION OF SPECIFIC EMBODIMENTS

Figure 1:
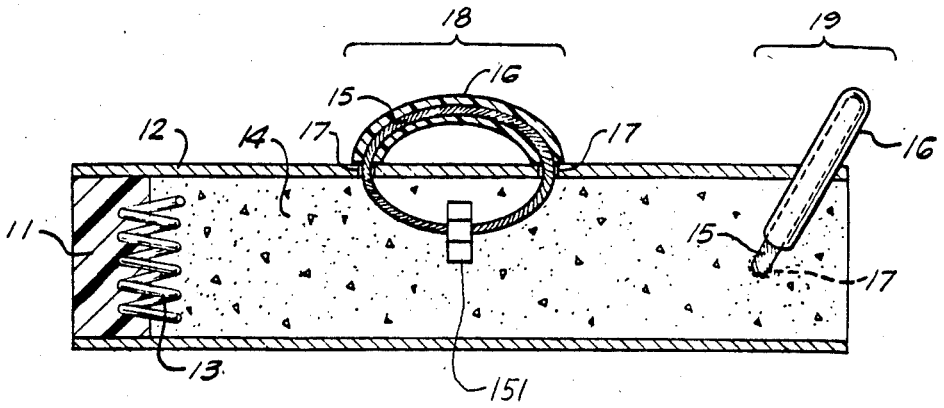
FIG. 1 shows a longitudinal section of a preferred embodiment of the invention.
Figure 2:
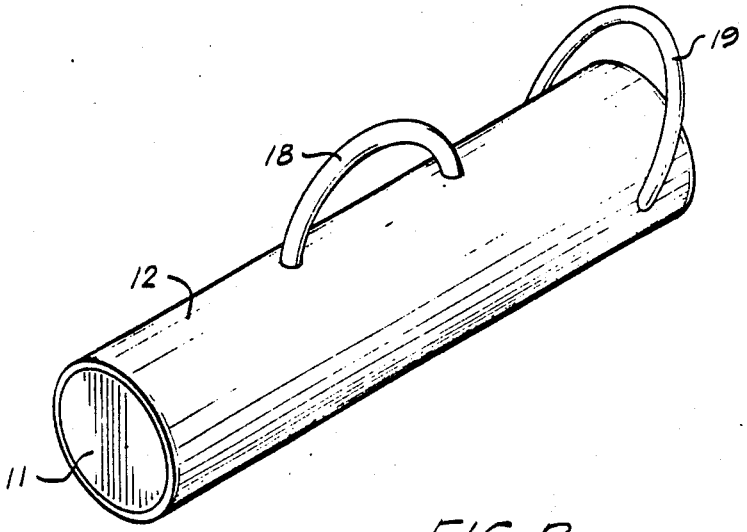
FIG. 2 is a perspective view of the exterior of the embodiment of FIG. 1.

In a preferred embodiment of the invention, shown in FIG. 1, the body of the ram is made up of a light, strong crack-resistant tubing 12 filled with a dense, moldable, curable material 14, such as concrete. Handles 18 and 19, made of heavy stranded steel cable 15, are threaded through holes 17 in the tubing 12 and imbedded in the concrete before it hardens. The ends of the cable may be secured by any suitable means, including anchoring them in the concrete, or additionally by clamps 151 of the type used to secure such cable in guy wire applications. The portion of the cable outside of the tubing 12 is covered with a flexible, sturdy material 16, such as a conventional plastic sleeve or plastic coating, to facilitate handling. One of the two handles 17 is placed near the center of the long axis of the ramming body. The other handle 18 is placed at one end of the ramming body. The other end, which is the end that will contact the barrier to be penetrated, is covered with a moldable, curable, resilient material, such as epoxy resin, to form a contact face 11. This end may be advantageously retained in the tubing 12, for example, by means of a wire coil 13 or other suitable structure of which one portion is imbedded in the dense material 14 and another portion is imbedded in the contact face 11. Other means of retaining may be provided by the natural adhesion of the contact face 11 or by a suitable fastening arrangement directly to the tubing. Satisfactory results have been achieved by using a 28-inch 0.71-meter) length of 4-inch (0.10-meter) PVC tubing filled with concrete; $2\frac{1}{4}$-inch steel cable for the handles secured by clamps inside the tube; Synflex-brand GP-36 low pressure hose to cover the handles; one-half inch of Marine-Tex-brand epoxy resin for the ramming end; and a wire coil of welder's flux introduced into the wet conrete and the uncured Marine-Tex at their contacting surface to strengthen the adhesion between the two materials. A perspective view of the embodiment in FIG. 1 is shown in FIG. 2.

Figure 3:
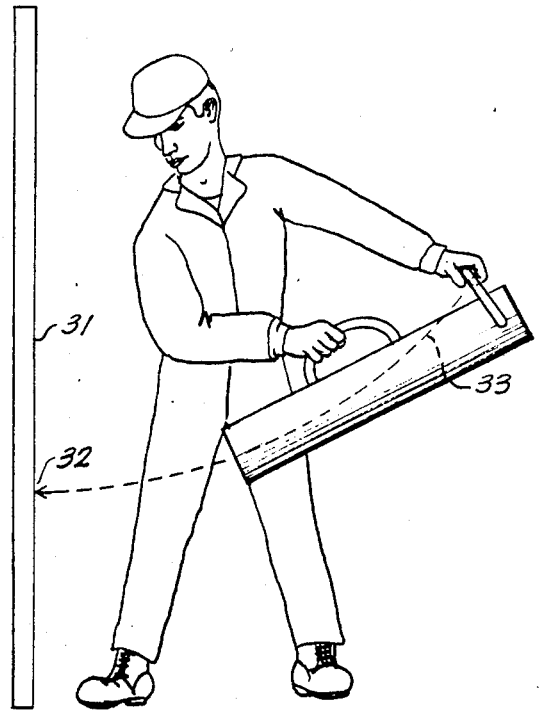
FIG. 3 shows a method for using the preferred embodiment of FIG. 1.

Instead of using the "whole-body" movement utilized by the two-person ram, the method of the present invention uses the movement of the two arms, as depicted in FIG. 3. The user stands a short distance from the barrier 31 with his body transverse and approximately perpendicular to the barrier to be penetrated. The ram is held by the two handles so that the contact face 11 is closest to the barrier, with the inside hand on the center handle 18, and the outside hand on the end handle 19. The ram is lifted back along the natural arc 33 formed by the backward movement of the arms at full or near-full extension. The ram is then rapidly lowered along the same arc, generating a certain momentum along the arc which is translated into force at the point of contact 32 with the barrier to be penetrated. Because the velocity generated by this rapid downward motion is significantly greater than the velocity typically generated by two men running with a two-person ram, the mass of the one-man ram can be significantly lower than that of the two-person ram to create comparable kinetic energy and therefore force at impact.

As described below, calculations based on measurements taken in an experiment indicate that approximately 12,600 pounds (approximately 56,000 newtons), or more than six tons (approximately 6 metric tons), of force is generated at the point of impact.

Figure 4:
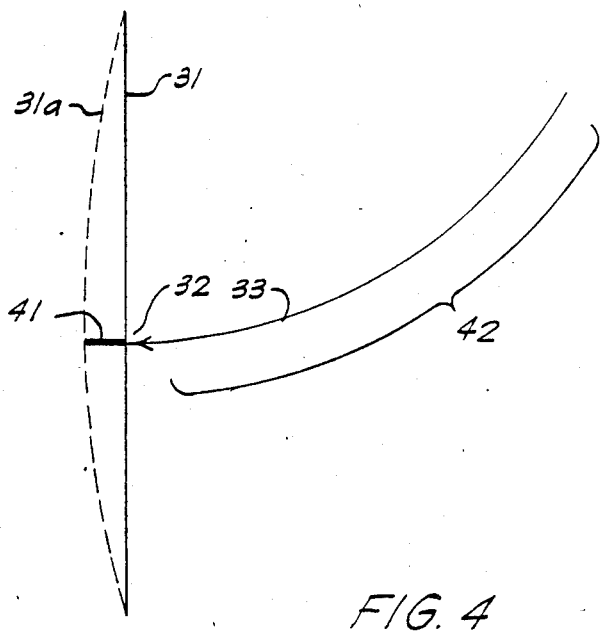
FIG. 4 is a schematic of the preferred method of FIG. 3, illustrating the physics of the ram for purposes of an analysis given below.

Turning to FIG. 4, the ram may be viewed as performing work at the point of impact 32, since it is exerting a force against the barrier 31 that causes the barrier to move a measurable distance 41. Assuming that this force is constant over the distance, the work performed may be expressed by the formula $$W=FD \quad (1)$$

where

W = the work performed

F = the force exerted against the barrier and

D = the distance 41 through which the barrier is moved.

The amount of work performed is also equal to the change in kinetic energy of the ram. At the point of impact 32, the ram has a certain kinetic energy. After impact, the kinetic energy has dropped to zero. Thus, the change in energy ΔE of the ram, before and after impact, can be expressed by the formula:

$$W=\Delta E=\tfrac{1}{2}m(v_f)^2 \quad (2)$$

where:

m = the mass of the ram $v_f$ = the velocity of the ram at impact.

From equations (1) and (2), it can be seen that doubling the final velocity, that is, the velocity at impact, results in a fourfold increase in the kinetic energy and therefore the available force at the time of impact. Thus, a relatively small mass can be used to generate a large force at impact.

Assuming a constant acceleration of $a_f$ of the ram along the distance 42 traveled along the arc formed by moving the ram with the arms at full or near-full extension, we know that:

$$s=\tfrac{1}{2}a_f(t_s)^2$$

where s = the distance 42 traveled along the arc $t_s$ = the time elasped along s.

Solving for $a_f$, we know that $$a_f=2s/(t_s)^2.$$

We know that $a_f t_s$ is approximately equal to $v_f$. Therefore, multiplying both sides by $t_s$ and substituting, we know that $$v_f=2s/t_s.$$

Substituting for $V_{f\ in\ equation}$ (2) we now know that the change in energy ΔE at the point of impact is approximately equal to:

$$\Delta E=m2s^2/(t_s)^2.$$

Using the additional relation $\Delta E=W=FD$, the force F may be approximated as follows:

$$F=2ms^2/D(t_s)^2.$$

Experimentally, with a ram having a mass corresponding to a weight of approximately 30 lbs. (i.e., a mass of just under one slug) (14 kilograms) and an arc length of approximately 5 feet (1.5 meters), there was observed an indentation of approximately 0.01 feet (0.003 meters) after a measured travel time of approximately 0.63 seconds. Substituting these figures into the above equation yields a force F at the point of impact of approximately 12,600 pounds (approximately 56,000 newtons), or over 6 tons (about 6 metric tons). Although these measurements apply to a ram of the aforesaid mass, there is a wide range of masses for a ram in accordance with the present invention.

What is claimed is:

1. A battering ram suitable for use by one person in battering an object, the battering ram comprising:

(a) a substantially cylindrical solid body having a longitudinal axis, a length along such axis, and first and second opposing ends through which such axis passes, having a weight in excess of ten pounds but insufficient to prevent its being carried by one person, and sufficiently compact to permit its ready transport in a car trunk or other similar enclosure;

(b) a first handle attached to the body proximate to the location of the center of gravity of the body along its longitudinal axis, said first handle extending parallel to said axis to allow the user to hold the body and to swing it along its longitudinal axis along the natural arc formed by the movement of a user's arms at full or near-full extension with sufficient ease to generate momentum for battering the object, wherein the handle projects radially outwardly from the body a distance substantially less than the length of the body;

(c) a second handle attached to the body at the second end thereof and being transverse to the direction of said first handle; and (d) a contact face, disposed at the first end of the body, for making physical contact with the object, the contact face having sufficient compressive strength and resilience as not to crack or shatter upon repeated heavy blows against the object.

2. A battering ram suitable for use by one person in battering an object, the battering ram comprising:

(a) a substantially solid body having a longitudinal axis, a length along such axis, and first and second opposing ends through which such axis passes, having a weight in excess of ten pounds but insufficient to prevent its being carried by one person;

(b) a first handle attached to the body proximate to the location of the center of gravity of the body along its longitudinal axis, to allow the user to hold the body and to swing it along its longitudinal axis with sufficient ease to generate momentum for battering the object, wherein the handle projects radially outwardly from the body a distance substantially less than the length of the body, the first handle including a cable threaded through spaced holes in the tube in such a way as to cause a loop of such cable to protrude outwardly from the tube, the portion of such cable within the tube being embedded in concrete;

(c) a second handle attached to the body at the second end thereof; and (d) a contact face, disposed at the first end of the body, for making physical contact with the object, the contact face having sufficient compressive strength and resilience as not to crack or shatter upon repeated heavy blows against the object.

3. A battering ram according to claim 2, wherein the contact face includes plastic resin.

4. A battering ram according to claim 3, wherein the contact face includes epoxy resin.

5. A battering ram according to claim 3, wherein the body includes a reinforcing element embedded in the concrete and protruding therefrom into the contact face, a portion of the reinforcing element being so embedded in the contact face, so that the contact face is prevented from separating from the body.

* * * * *